US011094516B2

(12) United States Patent
Yamamoto et al.

(10) Patent No.: US 11,094,516 B2
(45) Date of Patent: Aug. 17, 2021

(54) MASS SPECTROMETER, MASS SPECTROMETRY METHOD, AND MASS SPECTROMETRY PROGRAM

(71) Applicant: SHIMADZU CORPORATION, Kyoto (JP)

(72) Inventors: Hideki Yamamoto, Kyoto (JP); Atsuhiko Toyama, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 39 days.

(21) Appl. No.: 16/629,386

(22) PCT Filed: Jul. 10, 2017

(86) PCT No.: PCT/JP2017/025171
§ 371 (c)(1),
(2) Date: Jan. 8, 2020

(87) PCT Pub. No.: WO2019/012589
PCT Pub. Date: Jan. 17, 2019

(65) Prior Publication Data
US 2020/0152434 A1 May 14, 2020

(51) Int. Cl.
*H01J 49/00* (2006.01)
*H01J 49/40* (2006.01)

(52) U.S. Cl.
CPC ..... *H01J 49/0031* (2013.01); *H01J 49/40* (2013.01)

(58) Field of Classification Search
USPC ..... 250/282
See application file for complete search history.

(56) References Cited

U.S. PATENT DOCUMENTS 8,067,728 B2 * 11/2011 Thomson ..... H01J 49/0036 250/282
10,068,753 B2 * 9/2018 Bloomfield ..... H01J 49/004
(Continued)

FOREIGN PATENT DOCUMENTS

CA 2905122 A1 12/2014
CN 105190828 A 12/2015
(Continued)

OTHER PUBLICATIONS

Ludovic C. Gillet et al., "Targeted Data Extraction of the MS/MS Spectra Generated by Data-independent Acquisition: A New Concept for Consistent and Accurate Proteome Analysis", Molecular & Cellular Proteomics 11.6, Jan. 18, 2012, vol. 11, No. 6.
(Continued)

*Primary Examiner* — Phillip A Johnston
(74) *Attorney, Agent, or Firm* — Sughrue Mion, PLLC

(57) ABSTRACT

A device that performs MSn analysis including: a mass window group setting information input receiver that receives input of information concerning the number of mass window groups, the number of mass windows, and a mass-to-charge ratio width of each of the mass windows; a mass window group setter that sets a first mass window group and a second mass window group, in which a mass-to-charge ratio at a boundary of adjacent mass windows differs from a mass-to-charge ratio at a boundary of mass windows in the first mass window group; a product-ion scan measurement section that performs, for each of the first and second mass window groups, an operation of performing scan measurement of product ions by use of the plurality of mass windows in sequence to acquire pieces of product-ion scan data; and a product-ion spectrum generator that generate a product-ion spectrum by integrating pieces of product-ion scan data.

9 Claims, 7 Drawing Sheets

(56) References Cited

U.S. PATENT DOCUMENTS

| | | | | |
|---|---|---|---|---|
| 10,074,526 | B2 * | 9/2018 | Bonner | H01J 49/04 |
| 10,665,442 | B2 * | 5/2020 | Ashida | H01J 49/0031 |
| 2003/0228630 | A1 | 12/2003 | Tsuda et al. | |
| 2012/0303288 | A1 | 11/2012 | Morinaga | |
| 2015/0025813 | A1 | 1/2015 | Collings | |
| 2016/0086783 | A1 | 3/2016 | Cox et al. | |

FOREIGN PATENT DOCUMENTS

| | | | |
|---|---|---|---|
| EP | 3005400 | A1 | 4/2016 |
| JP | 2004-012355 | A | 1/2004 |
| JP | 2012-247198 | A | 12/2012 |
| JP | 2016-524712 | A | 8/2016 |
| WO | 2014/132387 | A1 | 9/2014 |
| WO | 2014/195785 | A1 | 12/2014 |

OTHER PUBLICATIONS

International Search Report for PCT/JP2017/025171 dated Sep. 19, 2017. [PCT/ISA/210].
Written Opinion of the International Searching Authority for PCT/JP2017/025171 dated Sep. 19, 2017. [PCT/ISA/237].

* cited by examiner

Fig. 3

INPUT INFORMATION ON SETTING OF MASS WINDOW GROUPS.

MEASUREMENT RANGE (m/z) 400 ~ 1400

NUMBER OF MASS WINDOW GROUPS 5

NUMBER OF MASS WINDOWS PER GROUP 40

MASS WINDOW WIDTH (m/z) 25

SET CANCEL

MASS SPECTROMETER, MASS SPECTROMETRY METHOD, AND MASS SPECTROMETRY PROGRAM

CROSS REFERENCE TO RELATED APPLICATIONS

This application is a National Stage of International Application No. PCT/JP2017/025171 filed Jul. 10, 2017.

TECHNICAL FIELD

The present invention relates to a mass spectrometer, a mass spectrometry method, and a mass spectrometry program.

BACKGROUND ART

As mass spectrometry techniques used for analyzing the structure of a compound contained in a sample, tandem analysis ($MS^2$ analysis) and $MS^n$ analysis are known. Tandem analysis is an analysis technique that selects precursor ions out of various kinds of ions generated from a compound in a sample, dissociates the precursor ions by dissociation operation such as collision-induced dissociation (CID), and performs mass spectrometry on the product ions generated by the dissociation of the precursor ions. $MS^n$ analysis is an analytical technique that repeats the selection of precursor ions and the dissociation operation for the precursor ions a plurality of times. $MS^n$ analysis is used for a structural analysis of a polymer compound that is difficult to dissociate into sufficiently small fragments by only one-time dissociation operation. Tandem analysis and $MS^n$ analysis are performed using a mass spectrometer such as a quadrupole-time-of-flight mass spectrometer (Q-TOF) equipped with a pre-stage mass separator, collision cell, and a post-stage mass separator.

In tandem analysis and $MS^n$ analysis, the following technique called data-dependent analysis (DDA) is used: selecting ions with a specific mass-to-charge ratio as precursor ions on the basis of the mass peak intensity of a previously acquired mass spectrum and performing scan measurement of product ions generated from the precursor ions. On the other hand, the following technique called data-independent analysis (DIA) is also used: dividing the mass-to-charge ratio range to be measured into a plurality of portions, setting a mass window for each of the portions, collectively selecting precursor ions with the mass-to-charge ratio within the respective mass windows, and comprehensively performing scan measurement of product ions generated from the precursor ions (e.g., Patent Literature 1). For example, when data independent analysis is performed on a target compound temporally separated and eluted from a liquid chromatograph, "events" are repeatedly executed during the elution time (retention time) of the target compound, where, in an event, for the plurality of mass windows, precursor ions are selected using a mass window, and the product ions generated by the dissociation of the precursor ions are scan measured. Then, the product-ion scan data acquired in the repeatedly executed events are summed up or averaged to create a product-ion spectrum. The product-ion spectrum is subjected to, for example, matching processing with a product-ion spectrum recorded in a database, and the target compound is identified on the basis of the degree of coincidence between the product-ion spectrums.

Patent Literature 1 describes an example of DIA. In the mass range of 400 to 1200 Da, 32 adjacently aligning mass windows each having mass width of 25 Da are set, and precursor ions are selected using each of the mass windows to acquire a product-ion spectrum. The mass windows are set by applying a DC voltage and a radio-frequency voltage that form a stable region of ions, obtained as a solution of the Mathiu's equation, to each of electrodes of a quadrupole or the like constituting a pre-stage mass separator. However, ions with a mass-to-charge ratio at the end portion of the stable region of ions, that is, the end portion of the mass window, are less likely to pass through the mass separator compared to ions with a mass-to-charge ratio near the center of the mass window. Thus, due to low measurement sensitivity of the product ions generated by the dissociation of the precursor ions with the mass-to-charge ratio at the end portion of the mass window, it is difficult to obtain a product-ion spectrum with a sufficient intensity, which has been problematic. Hence there has been an attempt to enhance the sensitivity by overlapping mass-to-charge ratios at the end portions of the adjacent mass windows and measuring product ions, generated by dissociation of precursor ions with the mass-to-charge ratios at the end portions of the mass windows, in both product-ion scan measurements using the two mass windows (e.g., Non Patent Literature 1).

CITATION LIST

Patent Literature

Patent Literature 1: US 2015/0025813 A

Non Patent Literature

Non Patent Literature 1: Ludovic C. Gillet et al., "Targeted Data Extraction of the MS/MS Spectra Generated by Data-independent Acquisition: A New Concept for Consistent and Accurate Proteome Analysis", Molecular & Cellular Proteomics, vol. 11, no. 6, 18 Jan. 2012, 10.1074/mcp.0111.016717

SUMMARY OF INVENTION

Technical Problem

When the end portions of the adjacent mass windows are overlapped and the mass-to-charge ratios at the overlapped end portions are used as described above, the product ions generated from the precursor ions with the mass-to-charge ratios at those end portions can be measured with sufficient intensity. However, as for the precursor ions with the mass-to-charge ratios in the range where the mass-to-charge ratios overlap, the product ions are measured by the respective product-ion scan measurements using the two adjacent mass windows, while in the other portions, product ions are measured only by the product-ion scan measurement using one mass window. Therefore, the product ions generated from the precursor ions with the mass-to-charge ratio located in the overlapping portion of the mass windows and the product ions generated from the precursor ions with the other mass-to-charge ratios are measured with different sensitivities, thus causing a problem where it is difficult to obtain a product-ion spectrum with correct intensity.

The problem to be solved by the present invention is to obtain a product-ion spectrum with sufficient and correct intensity in $MS^n$ analysis (n is an integer of 2 or more) that selects precursor ions out of ions derived from a sample by use of mass windows each having a mass-to-charge ratio width and performs scan measurement of product ions generated by dissociation of the precursor ions.

Solution to Problem

A first aspect of the present invention made to solve the above problems is a mass spectrometry method for performing $MS^n$ analysis (n is an integer of 2 or more) that selects precursor ions out of ions derived from a sample by use of mass windows each having a mass-to-charge ratio width and performs scan measurement of product ions generated by dissociation of the precursor ions, the method including:

a) setting a first mass window group which is a set of a plurality of mass windows each having a mass-to-charge ratio width for a measurement target range of mass-to-charge ratios of the precursor ions;

b) setting, for the measurement target range, a second mass window group which is a set of a plurality of mass windows each having a mass-to-charge ratio width and in which a mass-to-charge ratio at a boundary of adjacent mass windows differs from a mass-to-charge ratio at a boundary of mass windows in the first mass window group;

c) performing, for each of the first mass window group and the second mass window group, a product-ion scan measurement for the plurality of mass windows to respectively acquire pieces of product-ion scan data; and d) generating a product-ion spectrum by integrating the pieces of product-ion scan data.

The number of mass windows constituting the first mass window group and the number of mass windows constituting the second mass window group may be the same or different. Further, three or more mass window groups may be set.

In the mass spectrometry method according to the present invention, a first mass window group which is a set of a plurality of mass windows each having a mass-to-charge ratio width is set for a measurement target range of mass-to-charge ratios of the precursor ions, and a second mass window group, which is a set of a plurality of mass windows each having a mass-to-charge ratio width and in which a mass-to-charge ratio at a boundary of adjacent mass windows differs from a mass-to-charge ratio at a boundary of mass windows in the first mass window group, is set for the measurement target range. Then, a series of measurement, which uses a plurality of mass windows in sequence to perform an operation of selecting precursor ions by use of the mass windows and performing scan measurement product ions generated by dissociation of the precursor ions, is performed on each of the first mass window group and the second mass window group. For example, the first mass window group which is a set of mass windows A-1 to A-10 and the second mass window group which is a set of mass windows B-1 to B-11, set for the measurement target range of the mass-to-charge ratios of the precursor ions, are prepared in advance. Then, the product-ion scan measurement is performed using the mass windows A-1 to A-10 in sequence, and subsequently, the product-ion scan measurement is performed using the mass windows B-1 to B-11 in sequence, to respectively acquire pieces of product-ion scan data. In the mass spectrometry method according to the present invention, a plurality of mass window groups having different mass-to-charge ratios at the boundaries of the mass windows are used. Thus, for example, the mass-to-charge ratio corresponding to the boundary of the mass windows in the first mass window group is positioned near the center of the mass window in the second mass window group, so that it is possible to measure product ions, generated from the mass-to-charge ratio, with sufficient sensitivity by the product-ion scan measurement using the second mass window group. As thus described, since the mass-to-charge ratio corresponding to the boundary of the mass windows is different between the mass window groups, by integrating pieces of product-ion scan data acquired for the respective mass window groups, the influence of the boundaries can be reduced to obtain a product-ion spectrum with sufficient and correct intensity.

The adjacent mass windows may be in contact with each other, may overlap, or may be separated. Further, the mass-to-charge ratio widths of the plurality of mass windows included in each mass window group may be the same or different.

When the adjacent mass windows overlap, the range of the overlapping mass-to-charge ratios may be different for each mass window group. When the adjacent mass windows are separated from each other, the range of the separated mass-to-charge ratios may be different for each mass window group, and the range of the separated mass-to-charge ratios may be included in the mass window of another mass window group. Thereby, product ions can be measured with sensitivity closer to that in the uniformity.

As a method for integrating the pieces of product-ion scan data, there can be employed a method in which all the pieces of product-ion scan data are summed up or averaged to obtain mass peak intensity, a method in which, when a plurality of mass peak intensities with the same mass-to-charge ratio are obtained, a mass peak having the highest intensity among them is selected, or some other method.

Further, a second aspect of the present invention is a mass spectrometer for performing $MS^n$ analysis (n is an integer of 2 or more) that selects precursor ions out of ions derived from a sample by use of mass windows each having a mass-to-charge ratio width and performs scan measurement of product ions generated by dissociation of the precursor ions, the mass spectrometer including:

a) a mass window group setting information input receiver configured to receive input of information concerning the number of mass window groups that is set for a measurement target range of mass-to-charge ratios of the precursor ions, the number of a plurality of mass windows constituting each of the mass window groups, and a mass-to-charge ratio width of each of the mass windows;

b) a mass window group setter configured to set, on the basis of the input information, a first mass window group which is a set of a plurality of mass windows each having a mass-to-charge ratio width, and a second mass window group which is a set of a plurality of mass windows each having a mass-to-charge ratio width and in which a mass-to-charge ratio at a boundary of adjacent mass windows differs from a mass-to-charge ratio at a boundary of mass windows in the first mass window group;

c) a product-ion scan measurement section configured to perform, for each of the first mass window group and the second mass window group, an operation of performing a product-ion scan measurement using the plurality of mass windows in sequence to acquire pieces of product-ion scan data; and d) a product-ion spectrum generator configured to generate a product-ion spectrum by integrating the pieces of product-ion scan data.

Further, a third aspect of the present invention is a mass spectrometry program to be used for performing $MS^n$ analysis (n is an integer of 2 or more) that selects precursor ions out of ions derived from a sample by use of mass windows each having a mass-to-charge ratio width and performs scan measurement of product ions generated by dissociation of the precursor ions, the program causing a computer to operate as:

a) a mass window group setting information input receiver configured to receive input of information concerning the number of mass window groups that is set for a measurement target range of mass-to-charge ratios of the precursor ions, the number of a plurality of mass windows constituting each of the mass window groups, and a mass-to-charge ratio width of each of the mass windows;

b) a mass window group setter configured to set, on the basis of the input information, a first mass window group which is a set of a plurality of mass windows each having a mass-to-charge ratio width, and a second mass window group which is a set of a plurality of mass windows each having a mass-to-charge ratio width and in which a mass-to-charge ratio at a boundary of adjacent mass windows differs from a mass-to-charge ratio at a boundary of mass windows in the first mass window group;

c) a product-ion scan measurement section configured to perform, for each of the first mass window group and the second mass window group, an operation of performing a product-ion scan measurement using the plurality of mass windows in sequence to acquire pieces of product-ion scan data; and d) a product-ion spectrum generator configured to generate a product-ion spectrum by integrating the pieces of product-ion scan data.

Advantageous Effects of the Invention

By using the mass spectrometry method, the mass spectrometer, or the mass spectrometry program according to the present invention, it is possible to obtain a product-ion spectrum with sufficient and correct intensity in $MS^n$ analysis (n is an integer of 2 or more) that selects precursor ions out of ions derived from a sample by use of mass windows each having a mass-to-charge ratio width and performs scan measurement of product ions generated by dissociation of the precursor ions.

BRIEF DESCRIPTION OF DRAWINGS

FIG. 3 shows an example of an input screen for mass window group setting information in the present embodiment.

DESCRIPTION OF EMBODIMENTS

Embodiments of the mass spectrometer, the mass spectrometry method, and the mass spectrometry program according to the present invention will be described below with reference to the drawings.

Figure 1:
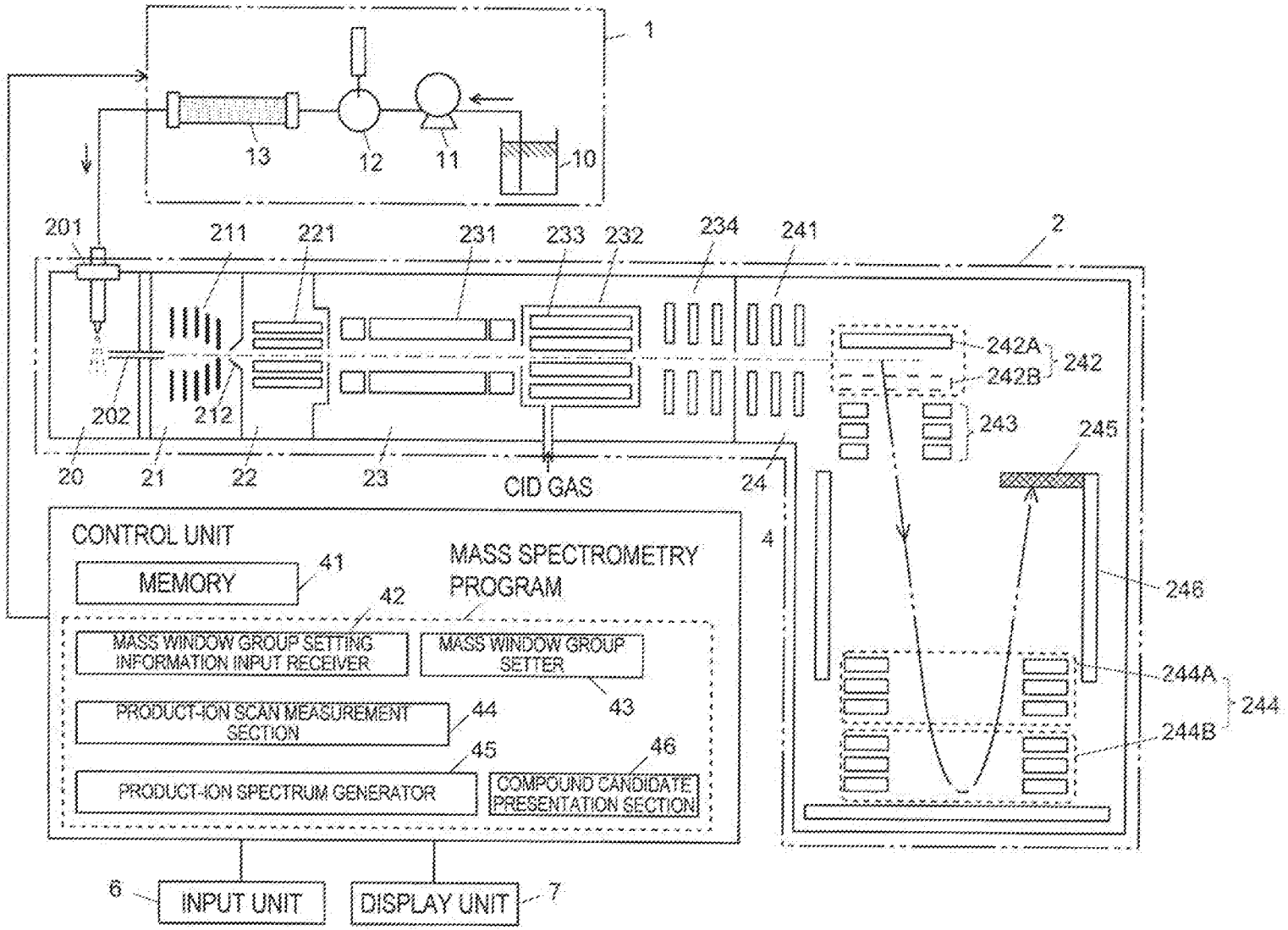
FIG. 1 is a configuration diagram of a main part of a liquid chromatograph mass spectrometer, which is one embodiment of a mass spectrometer according to the present invention.

The mass spectrometer of the present embodiment is a liquid chromatograph mass spectrometer that is a combination of a liquid chromatograph for temporally separating components in a sample and a mass spectrometer. As shown in FIG. 1, the liquid chromatograph mass spectrometer includes a liquid chromatograph unit 1, a mass spectrometry unit 2, and a control unit 4 that controls these operations.

In the liquid chromatograph mass spectrometer of the present embodiment, the liquid chromatograph unit 1 includes a mobile phase container 10 that stores a mobile phase, a pump 11 that sucks the mobile phase and delivers the sucked mobile phase at a constant flow rate, an injector 12 that injects a prescribed amount of sample liquid into the mobile phase, and a column 13 that separates various compounds contained in the sample liquid in the time direction.

The mass spectrometry unit 2 has a configuration of a multistage differential exhaust system including a first intermediate chamber 21, a second intermediate chamber 22, and a third intermediate chamber 23, the degrees of vacuum of which are increased stepwise, between an ionization chamber 20 at approximately atmospheric pressure and a high-vacuum analysis chamber 24 evacuated by a vacuum pump (not shown). In the ionization chamber 20, an electrospray ionization probe (ESI probe) 201 is installed to nebulize the sample liquid eluted from the column 13 of the liquid chromatograph unit 1 while applying a charge to the sample liquid.

The ionization chamber 20 and the first intermediate chamber 21 communicate with each other through a small-diameter heating capillary 202. The first intermediate chamber 21 and the second intermediate chamber 22 are separated by a skimmer 212 having a small hole at the top. In the first intermediate chamber 21 and the second intermediate chamber 22, ion guides 211, 221 are disposed respectively for transporting ions to the subsequent stage, while converging the ions. The third intermediate chamber 23 is provided with a quadrupole mass filter 231 that separates ions in accordance with the mass-to-charge ratio, a collision cell 232 having a multipole ion guide 233 inside, and an ion guide 234 for transmitting the ions emitted from the collision cell 232. A CID gas such as argon or nitrogen is continuously or intermittently supplied into the collision cell 232.

The analysis chamber 24 includes an ion transport electrode 241 for transporting the ions incident from the third intermediate chamber 23 to an orthogonal acceleration region, an orthogonal acceleration electrode 242 made up of two electrodes 242A, 242B disposed facing each other across the orthogonal acceleration region on the incident optical axis of the ions, an acceleration electrode 243 that accelerates the ions sent to flight space by the orthogonal acceleration electrode 242, a reflectron electrode 244 (244A, 244B) that forms a folded orbit of the ions in the flight space, a detector 245, and a flight tube 246 located at the outer edge of the flight space.

The mass spectrometry unit 2 can perform MS scan measurement, MS/MS scan measurement, or $MS^n$ scan measurement (n is an integer of 3 or more). Note that MS/MS scan measurement and $MS^n$ scan measurement (n is an integer of 3 or more) may be collectively referred to as $MS^n$ scan measurement (n is an integer of 2 or more). For example, in the case of MS/MS scan measurement (product-ion scan measurement), only ions set as precursor ions are allowed to pass through the quadrupole mass filter 231. Further, CID gas is supplied into the collision cell 232, and the precursor ions are dissociated to generate product ions. Then, the product ions are introduced into the flight space, and the mass-to-charge ratio is obtained on the basis of the time of flight of the product ions. Further, data obtained by product-ion scan measurement described later is stored sequentially.

The control unit 4 has a memory 41 and includes, as function blocks, a mass window group setting information input receiver 42, a mass window group setter 43, a product-ion scan measurement section 44, a product-ion spectrum generator 45, and a compound candidate presentation section 46. In addition, the control unit 4 has a function of controlling the operation of each of the liquid chromatograph unit 1 and the mass spectrometry unit 2. The entity of the control unit 4 may be a personal computer, and can be caused to function as each of the above units by executing a mass spectrometry program installed in advance in the computer. An input unit 6 and a display unit 7 are connected to the control unit 4.

The memory 41 stores, for each of a plurality of known compounds, a compound database in which information such as a compound name and a retention time is associated with product-ion spectrum data. As for the retention time, for example, elution start time and elution end time in use of each of the plurality of columns are stored. In addition, product-ion spectrum data acquired in advance (or recorded in the existing database) is stored together with information on precursor ions used to acquire the spectrum and information on a value of collision energy for dissociation of the precursor ions. The product-ion spectrum data is obtained by $MS^n$ measurement (n is an integer of 2 or more) and reflects the entire structure or a partial structure of a known compound.

Figure 2:
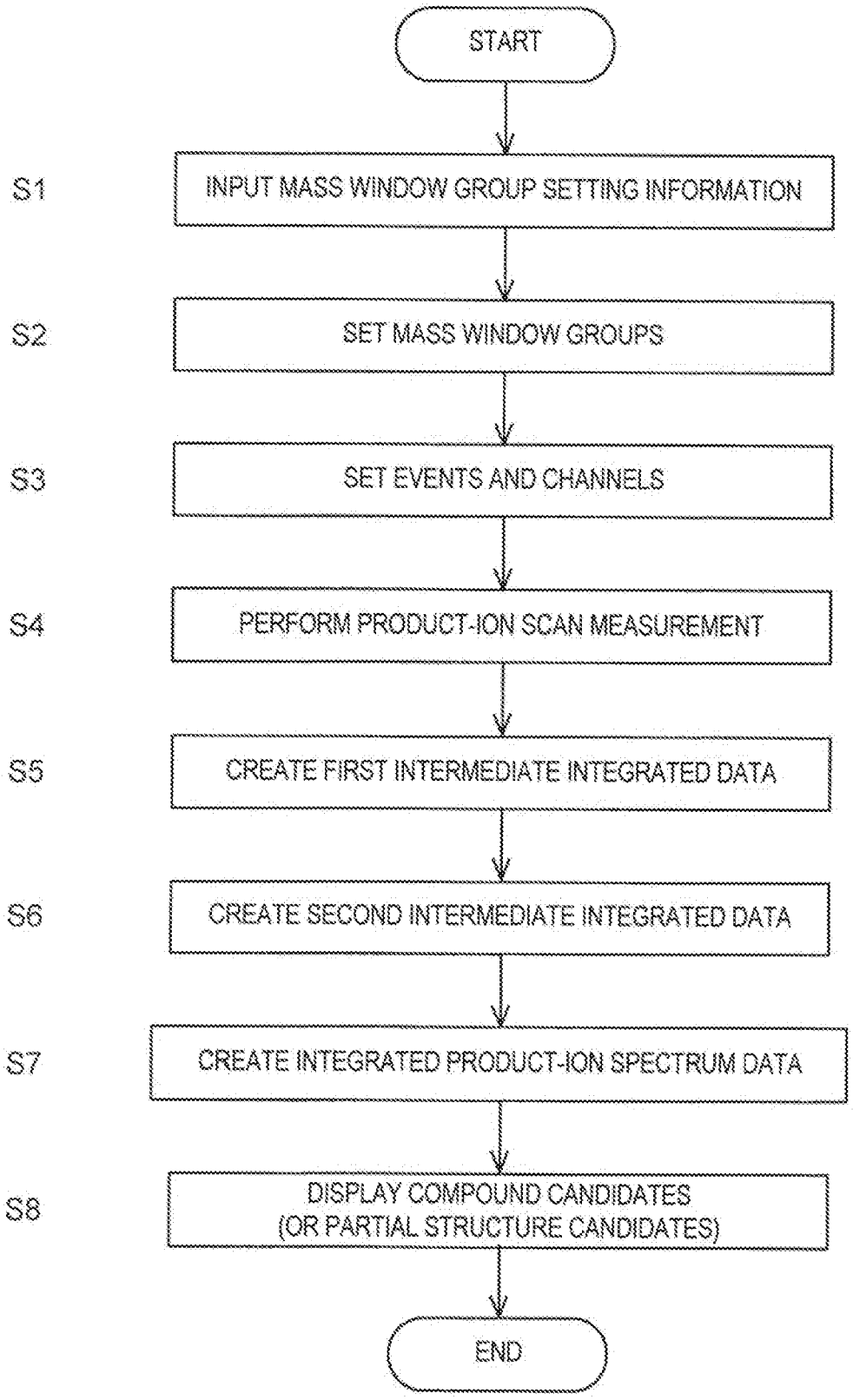
FIG. 2 is a flowchart of one embodiment of a mass spectrometry method according to the present invention.

Hereinafter, the mass spectrometry method in the present embodiment will be described with reference to the flowchart of FIG. 2. Here, a description will be given taking as an example a case where a plurality of compounds contained in a sample are temporally separated by the column 13 of the liquid chromatograph unit 1 and MS/MS scan measurement is performed. The MS/MS scan measurement performed here is data independent analysis (DIA) that divides the mass-to-charge ratio range of precursor ions to be measured into a plurality of parts, sets a mass window for each of the divided parts, collectively selects precursor ions with the mass-to-charge ratio of each mass window, and comprehensively performs scan measurement of product ions generated from the precursor ions. In the present embodiment, the case of MS/MS scan measurement will be described as an example, but even when $MS^n$ (n is an integer of 3 or more) measurement is performed, the flow of product-ion scan measurement and the like is the same as that of MS/MS scan measurement.

When a user instructs the start of analysis, the mass window group setting information input receiver 42 displays, on the display unit 7, a screen where a person who inputs data is caused to input information concerning the mass-to-charge ratio range of precursor ions to be used for performing the product-ion scan measurement, the number of mass window groups to be set for the mass-to-charge ratio range, and the number of mass windows constituting each mass window group as well as the mass-to-charge ratio width (step S1). FIG. 3 shows an example of the screen displayed. Note that the method for setting the mass window group described in the present embodiment is an example, and the mass window group can naturally be set by other methods.

In the present embodiment, a description will be given taking as an example a case where the user inputs the mass-to-charge ratio range of the precursor ions as 400 to 1400, the number of mass window groups as 5, and the number of mass windows included in each mass window group as 40. At the time when these numerical values are input, the mass window group setting information input receiver 42 presents a value (25), obtained by dividing the mass-to-charge ratio range (1000) of the precursor ions to be measured by the number of mass windows (40), to the user as an initial value of the mass-to-charge ratio width of each mass window.

Figure 4A:
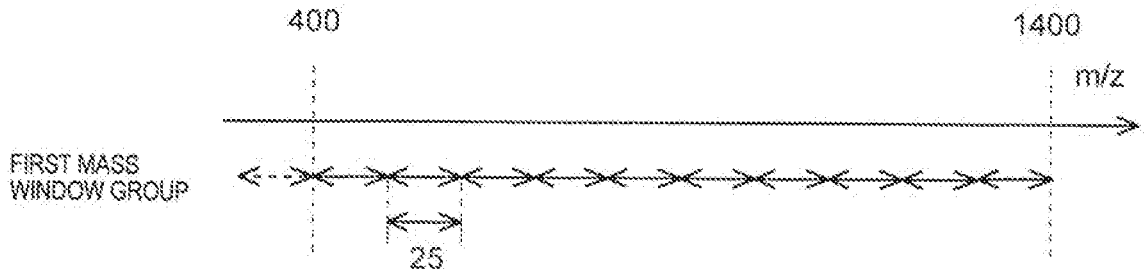
FIGS. 4A-4B are diagrams for explaining the setting of a mass window group in the present embodiment.
Figure 4B:
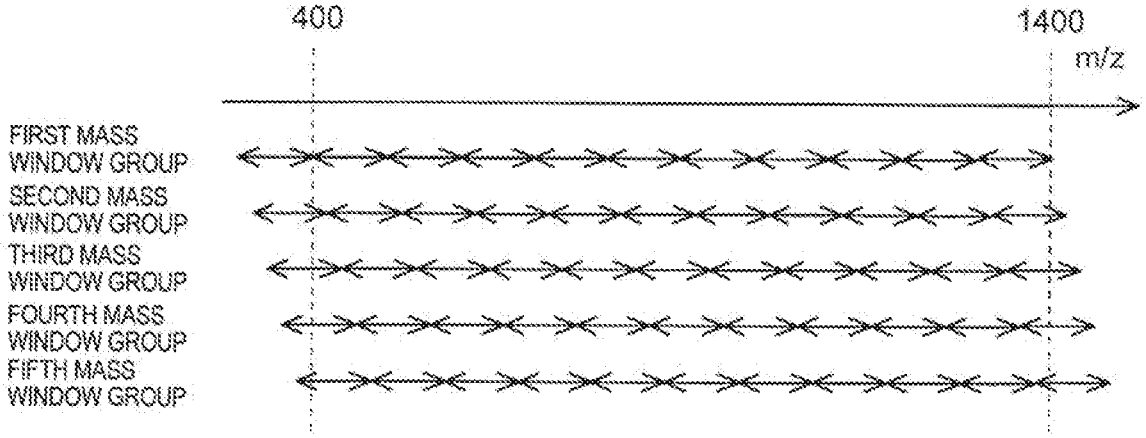
Figure 5:
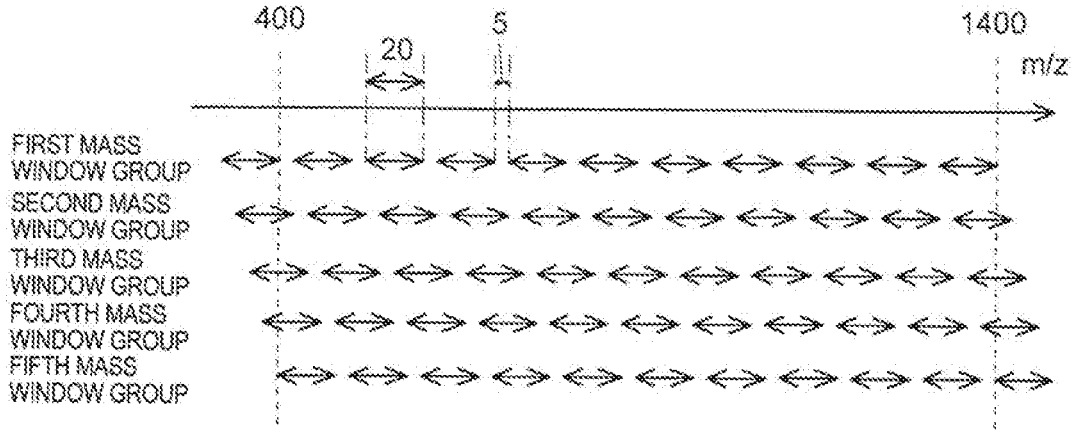
FIG. 5 is a diagram for explaining the setting of another mass window group in the present embodiment.
Figure 6:
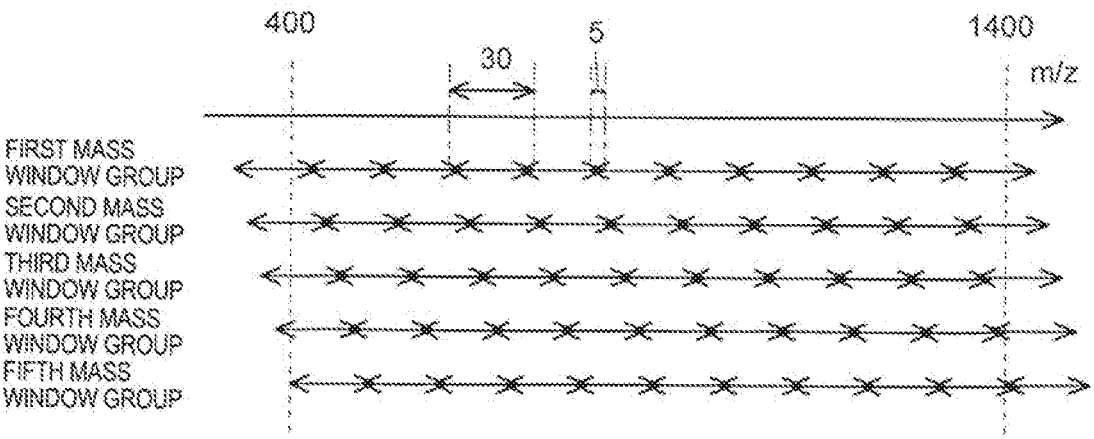
FIG. 6 is a diagram for explaining the setting of still another mass window group in the present embodiment.

When the user chooses to use this initial value as it is, the mass window group setter 43 first allocates 25 mass windows with a mass-to-charge ratio width of 40 in the mass-to-charge ratio range (400 to 1400) of the precursor ions to be measured. Then, one mass window (mass window indicated by a broken line in FIG. 4A) is added to the outside of the first mass window (with the smallest mass-to-charge ratio) (the side where the mass-to-charge ratio is smaller) to set a total of 26 mass windows (FIG. 4A). This completes the setting of the first mass window group. FIGS. 4 to 6 show the number of mass windows reduced.

Subsequently, the mass window group setter 43 divides the mass-to-charge ratio width (25) of each mass window by the number of mass window groups (5), and on the basis of the result, the mass window group setter 43 sets four mass window groups where the mass-to-charge ratio at which mass scanning is started is shifted by 5 each (the number of mass windows constituting each mass window group is 26=25+1). Thereby, a second mass window group to a fifth mass window group are set (FIG. 4B) (step S2).

Next, a description will be given of a case where the user changes the initial value of the mass-to-charge ratio width of the mass window presented by the mass window group setting information input receiver 42. When the user changes the initial value of the mass-to-charge ratio width to a smaller value (e.g., 20), the mass window group setter 43 first arranges 25 mass windows each having the minimum mass-to-charge ratio value of the mass window different by 25 (a value obtained by dividing the mass-to-charge ratio range to be measured by the number of mass windows) to set the first mass window group. In the same manner as described above, four mass window groups (second mass window group to fifth mass window group) are set where the mass-to-charge ratio at which the mass scanning is started is shifted by 5 each. In this case, the mass windows constituting each mass window group are set apart (e.g., by 5). FIG. 5 shows an example of the set mass window groups.

On the other hand, when the user changes the initial value of the mass-to-charge ratio width to a larger value (e.g., 30), the mass window group setter 43 first arranges 25 mass windows each having the minimum mass-to-charge ratio value of the mass window different by 25 to set the first mass window group, and then sets four mass window groups (second mass window group to fifth mass window group) where the mass-to-charge ratio at which the mass scanning is started is shifted by 5 each in the same manner as above. In this case, the mass windows constituting each mass window group are set so that the end portions of the adjacent mass windows overlap each other (e.g., 5 each). FIG. 6 shows an example of the set mass window groups.

Each time the above parameters are input to the screen displayed by the mass window group setting information input receiver 42, the mass window group setter 43 sets the number of mass window groups input on the basis of the parameter values, to display on the screen the setting of the mass window groups shown in each of FIGS. 4 to 6. The user can confirm whether or not the values input by himself or herself are appropriate through this screen. The user can also move the arrangement of the mass windows and the end portions of the mass windows on the screen by drag and drop operation. It is thereby possible to set the mass window group with each mass window having a different mass-to-charge ratio width, and individually change the separation distance and overlapping width of the adjacently disposed mass windows. For example, when it is expected from characteristics of a compound contained in the sample that a precursor ion with a known structure is generated, the setting of the mass window group can be changed so as to exclude from the mass window the mass range having the mass-to-charge ratio of the precursor ion as the center and provided with a slight margin on each side. However, even when such a change is made, it is preferable to cover the mass range excluded from the mass window of a certain mass window group by the mass window of another mass window group.

When the setting of the mass window groups by the mass window group setter 43 is completed and the user instructs the start of measurement, the product-ion scan measurement section 44 sets one event for each mass window group and sets one channel for each mass window to perform the product-ion scan measurement. In the case of the present embodiment, five events (event 1 to event 5) corresponding to the five mass window groups are set, and 26 channels (channel 1 to channel 26) corresponding to the 26 mass windows included in each event are set (step S3).

When setting the events and channels, the product-ion scan measurement section 44 injects the sample from the injector 12 of the liquid chromatograph unit 1. Then, the product-ion scan measurement is performed using the set events and channels in sequence (step S4). Specifically, first, measurement is performed on all the 26 channels in sequence, the measurement selecting precursor ions by use of channel 1 (a mass window with the lowest mass-to-charge ratio) of the event 1 (first mass window group) and performing scan measurement of product ions generated by dissociation of the selected precursor ions to acquire product-ion scan data. The product-ion scan data acquired is sequentially stored into the memory 41. When the measurement using channels 1 to 26 of event 1 in sequence is completed, subsequently, the measurement is sequentially performed using channels 1 to 26 of event 2. Such measurement is also performed for each channel of event 3 and the events after event 3, and when the measurement using channel 26 of event 5 is completed, the processing returns to channel 1 of event 1 again, and the same measurement is repeated. The product-ion scan measurement is completed when a predetermined measurement time has elapsed.

Figure 7:
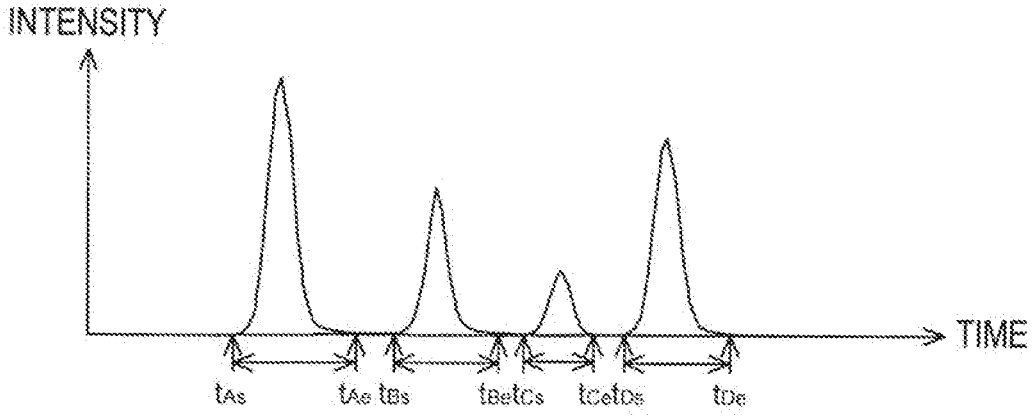
FIG. 7 is an example of a chromatogram obtained by measurement using a liquid chromatograph mass spectrometer of the present embodiment.

In a case where the sample contains a plurality of compounds, when these compounds are temporally separated by the column 13 and measured with the mass spectrometer, as shown in FIG. 7, a chromatogram (e.g., total ion chromatography) including peaks corresponding to the respective compounds is obtained. That is, as in the present embodiment, when the sample containing a plurality of compounds is temporally separated and measured, product-ion spectrum data including mass peaks that vary depending on the time period is obtained even in product-ion scan measurement using the same mass window group. Therefore, the mass spectrometer of the present embodiment processes the product-ion scan data, obtained by the product-ion scan measurement, as follows to create product-ion spectrum data for each compound.

The product-ion spectrum generator 45 first integrates pieces of product-ion scan data obtained by executing the respective events once. That is, pieces of product-ion scan data obtained using channels 1 to 26 of event 1 once in sequence are integrated. Also, for events 2 to 5, pieces of product-ion scan data are integrated in the same manner. Thereby, for each event, a plurality of pieces of product-ion scan data (data after the integration, hereinafter referred to as "first intermediate integrated data") having different execution start times of the event are obtained (step S5).

When precursor ions within the same mass-to-charge ratio range are selected and dissociated for the same compound, regardless of the execution time, the kind (mass-to-charge ratio) of product ions generated is the same in principle. That is, the mass-to-charge ratios of the mass peaks of the product-ion spectra obtained by measuring the same compound at the same event are basically the same. Therefore, the product-ion spectrum generator 45 next generates a list of mass-to-charge ratios in which a mass peak appears from each of the pieces of first intermediate integrated data obtained at the same event, and compares the lists with each other. Then, the pieces of first intermediate integrated data where the execution times are adjacent and the mass-to-charge lists for mass peaks are the same are handled as data obtained for the same compound, and data (hereinafter referred to as "second intermediate integrated data") obtained by further integrating the pieces of first intermediate integrated data is created (step S6). In the case of the example shown in FIG. 7, the second intermediate integrated data is generated from the pieces of first intermediate integrated data acquired between time $t_{As}$ and $t_{Ae}$, which is an elution time period of compound A. The same applies to compound B (time $t_{Bs}$ to $t_{Be}$), compound C (time $t_{Cs}$ to $t_{Ce}$), and compound D (time $t_{Ds}$ to $t_{De}$). From a time period when no compound is being eluted, spectrum data of product ions derived from a substance (e.g., mobile phase) except for the compounds contained in the sample can be obtained.

Figure 8A:
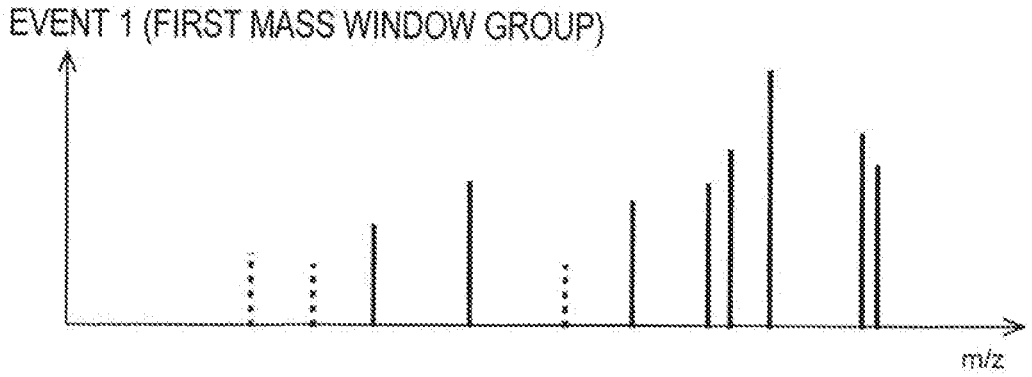
FIGS. 8A-8C are diagrams for explaining the generation of an integrated product-ion spectrum in the present embodiment.
Figure 8B:
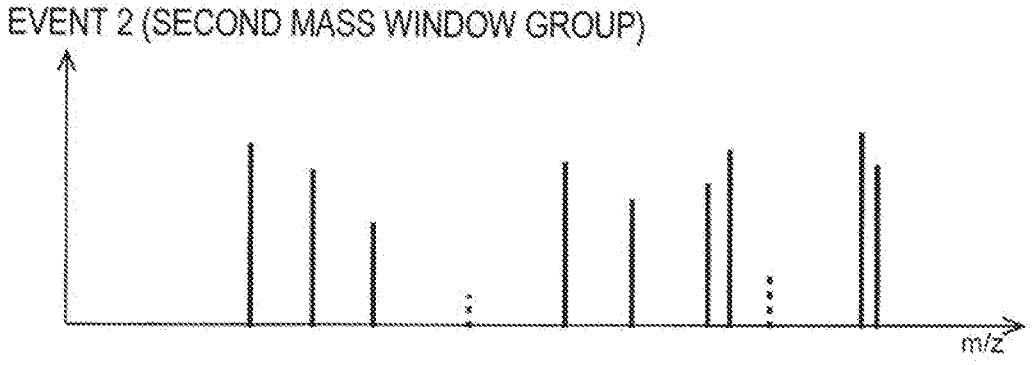
Figure 8C:
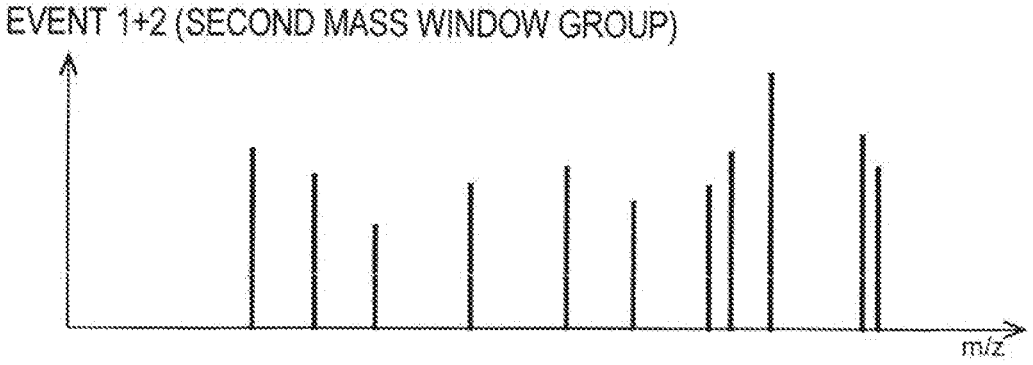

As a result of the above processing, the second intermediate integrated data is obtained in units of compounds for each event. Subsequently, the product-ion spectrum generator 45 integrates the pieces of second intermediate integrated data of different events for the compound to create integrated product-ion spectrum data (step S7). As shower FIGS. 8A-8C, when focusing only on the second intermediate integrated data of a certain event, at a mass-to-charge ratio corresponding to the end portion of the mass window set in the event, the passage efficiency of the precursor ions is poor compared to that at the other mass-to-charge ratios, and hence the detection intensity (peak intensity) of product ions is also small as shown by a broken line in the figure (FIGS. 8A and 8B). However, in the present embodiment, since the respective pieces of second intermediate integrated data are obtained for a plurality of events having different mass-to-charge ratios at the boundary of adjacent mass windows, further integrating these pieces of data enables reduction in the influence due to a decrease in the passage efficiency of the precursor ions at the end portion of the mass window (FIG. 8C). Although FIGS. 8A-8C show only events 1 and 2, the same applies to events 3 to 5. In the present embodiment, the integrated product-ion spectrum data is created by employing the mass peak with the highest intensity among the mass peaks having the same mass-to-charge ratio obtained in each event. However, the integrated product-ion spectrum data can be created by summing up or averaging the peak intensities of the pieces of second intermediate integrated data for each mass-to-charge ratio.

In particular, in the case of the present embodiment, the mass-to-charge ratio width of the mass window is 25, and the position of the mass window having the minimum mass-to-charge ratio is shifted by 5 each among the five events. That is, the mass window group is set so that the boundaries of the mass windows are evenly distributed within the mass-to-charge ratio range to be measured. Therefore, when the pieces of second intermediate integrated data obtained from these five events are integrated, the influence of the end portion of the mass window is almost completely averaged over the entire mass-to-charge ratio range of the precursor ions to be measured, and it is possible to obtain product-ion spectrum data reflecting more accurate product-ion intensity.

When the integrated product-ion spectrum data is obtained for each compound as thus described, the compound candidate presentation section 46 collates (the mass-to-charge ratio of the mass peak in) each piece of integrated product-ion spectrum data with (the mass-to-charge ratios of the mass peaks in) the pieces of product-ion spectrum data of a plurality of compounds recorded in the compound database stored in the memory 41. Then, the compound candidate presentation section 46 extracts a compound in which all mass peaks are included in the integrated product-ion spectrum data, and extracts compounds in descending order of reproducibility of the integrated product-ion spectrum data as compound candidates in predetermined number (or with the degrees of coincidence equal to or higher than a predetermined one) to display the extracted compounds on the display unit 7 together with the degrees of coincidence (step S8).

Figure 9:
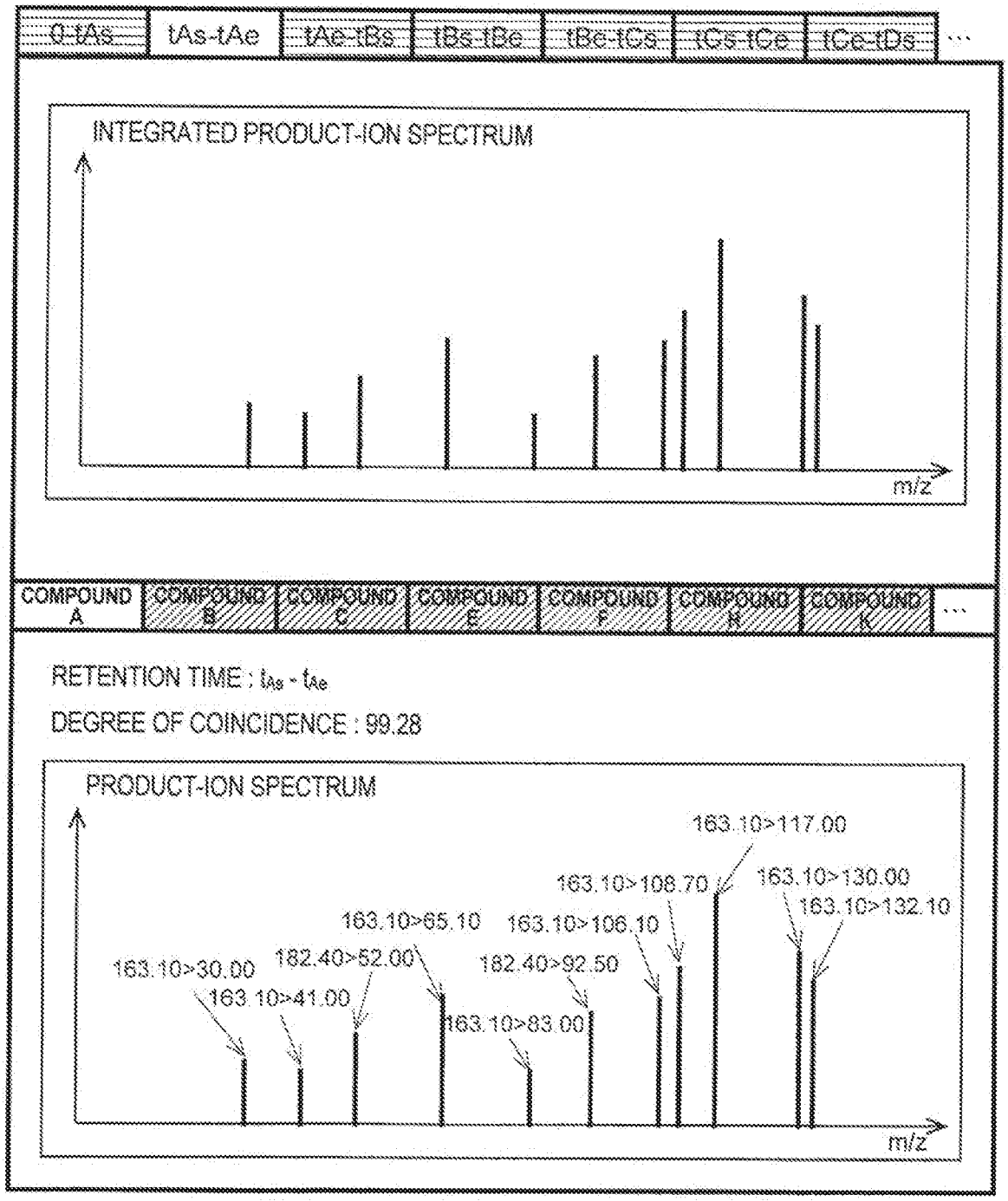
FIG. 9 is an example of a screen for presenting compound candidates in the present embodiment.

FIG. 9 is an example of a screen display showing that compound A has been extracted as a compound candidate from the integrated product-ion spectrum data obtained from the above-described product-ion scan measurement performed in the time period $t_{As}$-$t_{Ae}$. The user confirms the result displayed on the display unit 7 and identifies each compound (compounds A to D in the present embodiment) included in the sample. Here, the case has been described where the compound candidate is extracted only by collation of the product-ion spectrum, but the accuracy of the identification can be improved by extracting a compound candidate in consideration of information on retention time.

The compound candidate presentation section 46 may perform the following processing when being unable to extract a compound candidate with the degree of coincidence equal to or higher than a predetermined one by performing the above processing. For example, when all mass peaks of one piece of the product-ion spectrum data stored in the compound database (i.e., spectrum data corresponding to a partial structure of a compound) appear in the integrated product-ion spectrum, the compound included in the sample is taken as having the partial structure, and product-ion data corresponding to a partial structure of a different compound may be combined to reconstruct an integrated product-ion spectrum. In this case, a plurality of partial structure candidates used for the combination are displayed on the display unit 7. When the integrated product-ion spectrum cannot be reconstructed by combining a plurality of partial structure candidates, a mass peak corresponding to an unknown partial structure can also be displayed on the display unit 7 by removing a mass peak corresponding to a known partial structure from the integrated product-ion spectrum (or displaying the mass peak in a format distinguishable from the other mass peaks).

The embodiment described above is an example and can be appropriately changed along the gist of the present invention.

In the above embodiment, the liquid chromatograph mass spectrometer has been described as an example, but a gas chromatograph mass spectrometer or an electrophoresis apparatus capable of temporally separating the compounds contained in the sample as in the liquid chromatograph can be used in combination with the mass spectrometer. When the compound is isolated in advance, product-ion scan measurement or the like can be performed in the same manner as the above embodiment by using only the mass spectrometer. Further, in the above embodiment, the quadrupole-ion trap-time-of-flight (TOF) mass spectrometer has been used as the mass spectrometer, but other mass spectrometers having a pre-stage mass separator, a dissociation section, and a post-stage mass separator (e.g., an ion trap-TOF type, a triple quadrupole type, a TOF-TOF, etc.) may be used.

Moreover, in the above embodiment, the details of the measurement parameters except for the mass windows have not been described as to the product-ion scan measurement using each mass window group, but the measurement parameters may be the same or different for each mass window group. Examples of such measurement parameters include a value of collision energy for dissociating precursor ions and a set value of an ion accumulation mode in an ion trap and the like. Furthermore, in the above embodiment, the operation of performing the measurement on all the 26 channels in sequence may be taken as one set, the measurement selecting precursor ions by use of channel 1 (mass window with the lowest mass-to-charge ratio) of the event 1 (first mass window group) and performing scan measurement of product ions generated by dissociation of the selected precursor ions to acquire product-ion scan data, and the measurement parameters may be changed for each set. For example, by changing the value of the collision energy used for dissociating the precursor ions little by little for each mass window group and/or set, the precursor ions difficult to dissociate with certain collision energy can be dissociated by another collision energy, so that the product ions can be measured more comprehensively. Alternatively, a measurement parameter such as an ion accumulation mode in the ion trap may be changed for each mass window group and/or for each set. The measurement parameter to be changed for each mass window group and/or for each set may be one or plural.

In addition, it can also be configured such that, when the user inputs a mass-to-charge ratio of ions derived from a known partial structure or a contaminant compound at the point of creation of the integrated product-ion spectrum, the compound candidate presentation section 46 excludes the mass peak of the input mass-to-charge ratio from the integrated product-ion spectrum, displays the spectrum on the display unit 7, and then performs extraction of a compound candidate described above, and the like. Thereby, a compound candidate or a partial structure candidate can be extracted with only an unknown mass peak taken as a target.

REFERENCE SIGNS LIST

1 . . . Liquid Chromatograph Unit
10 . . . Mobile Phase Container
11 . . . Pump
12 . . . Injector
13 . . . Column
2 . . . Mass spectrometry Unit

20 . . . Ionization Chamber
201 . . . ESI Probe
202 . . . Heating Capillary
21 . . . First Intermediate Chamber
211 . . . Ion Guide
212 . . . Skimmer
22 . . . Second Intermediate Chamber
23 . . . Third Intermediate Chamber
231 . . . Quadrupole Mass Filter
232 . . . Collision Cell
233 . . . Multipole Ion Guide
234 . . . Ion Guide
24 . . . Analysis Chamber
241 . . . Ion Transport Electrode
242 . . . Orthogonal Acceleration Electrode
243 . . . Accelerating Electrode
244 . . . Reflectron Electrode
245 . . . Detector
246 . . . Flight Tube
4 . . . Control Unit
41 . . . Memory
42 . . . Mass Window Group Setting Information Input Receiver
43 . . . Mass Window Group Setter
44 . . . Product-ion scan Measurement Section
45 . . . Product-ion Spectrum Generator
46 . . . Compound Candidate Presentation Section
6 . . . Input Unit
7 . . . Display Unit

The invention claimed is:

1. A mass spectrometer for performing MSn analysis (n is an integer of 2 or more) that selects precursor ions out of ions derived from a sample by use of mass windows each having a mass-to-charge ratio width and performs scan measurement of product ions generated by dissociation of the precursor ions, the mass spectrometer comprising:

a mass window group setting information input receiver configured to receive input of information concerning the number of mass window groups that is set for a measurement target range of mass-to-charge ratios of the precursor ions, the number of a plurality of mass windows constituting each of the mass window groups, and a mass-to-charge ratio width of each of the mass windows;

a mass window group setter configured to set, on a basis of the input information, a first mass window group which is a set of a plurality of mass windows each having a mass-to-charge ratio width, and a second mass window group which is a set of a plurality of mass windows each having a mass-to-charge ratio width and in which a mass-to-charge ratio at a boundary of adjacent mass windows differs from a mass-to-charge ratio at a boundary of mass windows in the first mass window group;

a product-ion scan measurement section configured to perform, for each of the first mass window group and the second mass window group, an operation of performing product-ion scan measurement using the plurality of mass windows in sequence to acquire pieces of product-ion scan data; and a product-ion spectrum generator configured to generate a product-ion spectrum by integrating: intermediate integrated data obtained by integrating the pieces of product-ion scan data acquired using the plurality of mass windows included in the first mass window group where mass-to-charge ratios of mass peaks are same; and intermediate integrated data obtained by integrating the pieces of product-ion scan data acquired using the plurality of mass windows included in the second mass window group where mass-to-charge ratios of mass peaks are same.

2. The mass spectrometer according to claim 1, wherein the product-ion spectrum generator extracts a maximum intensity of the same mass-to-charge ratio for each of the plurality of pieces of product-ion scan data to generate a product-ion spectrum.

3. The mass spectrometer according to claim 1, wherein the first mass window group and the second mass window group are set so that boundaries of the mass windows are evenly distributed in the measurement target range of the mass-to-charge ratios of the precursor ions.

4. The mass spectrometer according to claim 1, further comprising:

a compound database in which product-ion spectrum data of each of one or more compounds is stored; and a compound candidate presentation section configured to extract a compound candidate or a partial structure candidate by collating the product-ion spectrum generated by the product-ion spectrum generator with the product-ion spectrum data.

5. The mass spectrometer according to claim 1, wherein the product-ion spectrum generator generates a product-ion spectrum excluding a mass peak with a mass-to-charge ratio specified in advance for the plurality of pieces product-ion scan data.

6. The mass spectrometer according to claim 1, wherein one or more measurement conditions except for the mass-to-charge ratio are different between product-ion scan measurement using the first mass window group and product-ion scan measurement using the second mass window group.

7. The mass spectrometer according to claim 6, wherein the one or more measurement conditions include a value of collision energy for dissociating the precursor ions.

8. A mass spectrometry method for performing MSn analysis (n is an integer of 2 or more) that selects precursor ions out of ions derived from a sample by use of mass windows each having a mass-to-charge ratio width and performs scan measurement of product ions generated by dissociation of the precursor ions, the method comprising:

setting a first mass window group which is a set of a plurality of mass windows each having a mass-to-charge ratio width for a measurement target range of mass-to-charge ratios of the precursor ions;

setting, for the measurement target range, a second mass window group which is a set of a plurality of mass windows each having a mass-to-charge ratio width and in which a mass-to-charge ratio at a boundary of adjacent mass windows differs from a mass-to-charge ratio at a boundary of mass windows in the first mass window group;

performing, for each of the first mass window group and the second mass window group, product-ion scan measurement for the plurality of mass windows to respectively acquire pieces of product-ion scan data; and generating a product-ion spectrum by integrating: intermediate integrated data obtained by integrating the pieces of product-ion scan data acquired using the plurality of mass windows included in the first mass window group where mass-to-charge ratios of mass peaks are same; and intermediate integrated data obtained by integrating the pieces of product-ion scan data acquired using the plurality of mass windows included in the second mass window group where mass-to-charge ratios of mass peaks are same.

9. A non-transitory readable medium recording a mass spectrometry program to be used for performing MSn analysis (n is an integer of 2 or more) that selects precursor ions out of ions derived from a sample by use of mass windows each having a mass-to-charge ratio width and performs scan measurement of product ions generated by dissociation of the precursor ions, the program causing a computer to operate as:

a mass window group setting information input receiver configured to receive input of information concerning the number of mass window groups that is set for a measurement target range of mass-to-charge ratios of the precursor ions, the number of a plurality of mass windows constituting each of the mass window groups, and a mass-to-charge ratio width of each of the mass windows;

a mass window group setter configured to set, on a basis of the input information, a first mass window group which is a set of a plurality of mass windows each having a mass-to-charge ratio width, and a second mass window group which is a set of a plurality of mass windows each having a mass-to-charge ratio width and in which a mass-to-charge ratio at a boundary of adjacent mass windows differs from a mass-to-charge ratio at a boundary of mass windows in the first mass window group;

a product-ion scan measurement section configured to perform, for each of the first mass window group and the second mass window group, an operation of performing product-ion scan measurement using the plurality of mass windows in sequence to acquire pieces of product-ion scan data; and a product-ion spectrum generator configured to generate a product-ion spectrum by integrating: intermediate integrated data obtained by integrating the pieces of product-ion scan data acquired using the plurality of mass windows included in the first mass window group where mass-to-charge ratios of mass peaks are same; and intermediate integrated data obtained by integrating the pieces of product-ion scan data acquired using the plurality of mass windows included in the second mass window group where mass-to-charge ratios of mass peaks are same.

* * * * *